US006595879B1

(12) United States Patent
Robbins

(10) Patent No.: US 6,595,879 B1
(45) Date of Patent: Jul. 22, 2003

(54) TRANSPORTABLE BASKETBALL GOAL WITH NET AND TRAINING TOOL

(76) Inventor: Keith Robbins, P.O. Box 230745, Tigard, OR (US) 97223

( * ) Notice: Subject to any disclaimer, the term of this patent is extended or adjusted under 35 U.S.C. 154(b) by 0 days.

(21) Appl. No.: 10/082,738

(22) Filed: Feb. 22, 2002

(51) Int. Cl.[7] ..... A63B 63/08
(52) U.S. Cl. ..... 473/489; 473/422
(58) Field of Search ..... 473/489, 485, 473/484, 486, 488, 487, 447, 472, 481, 479, 422

(56) References Cited

U.S. PATENT DOCUMENTS

| | | | | |
|---|---|---|---|---|
| 1,544,453 A | | 6/1925 | Harbison | |
| 4,793,611 A | * | 12/1988 | Thornell | 473/483 |
| 4,805,903 A | * | 2/1989 | McArdle | 473/489 |
| 4,834,368 A | | 5/1989 | Qualley | |
| 4,903,964 A | | 2/1990 | Anderson | |
| 5,098,091 A | | 3/1992 | McGivern | |
| 5,123,642 A | | 6/1992 | Stokes | |
| 5,360,208 A | | 11/1994 | Fang | |
| 5,405,132 A | | 4/1995 | St. Onge | |
| 5,447,304 A | | 9/1995 | Vargas | |
| 5,575,470 A | | 11/1996 | Sherman | |
| 6,312,350 B1 | | 11/2001 | White | |

* cited by examiner

*Primary Examiner*—Paul T. Sewell
*Assistant Examiner*—M. Chambers
(74) *Attorney, Agent, or Firm*—Rose Jade; William S. Lovell

(57) ABSTRACT

A transportable basketball rim and net with optional backboard blocking training tool assembly is provided for use on a pre-existing metal goal. The base rim with net is installed over and removed from a pre-existing metal goal without the use of a ladder. The net and training tool can be removably attached to the plastic rim before the assembly is installed on the hoop. The base includes an optional insert to allow installation of the rim over a six or five inch pre-existing mount.

18 Claims, 6 Drawing Sheets

Fig. 1
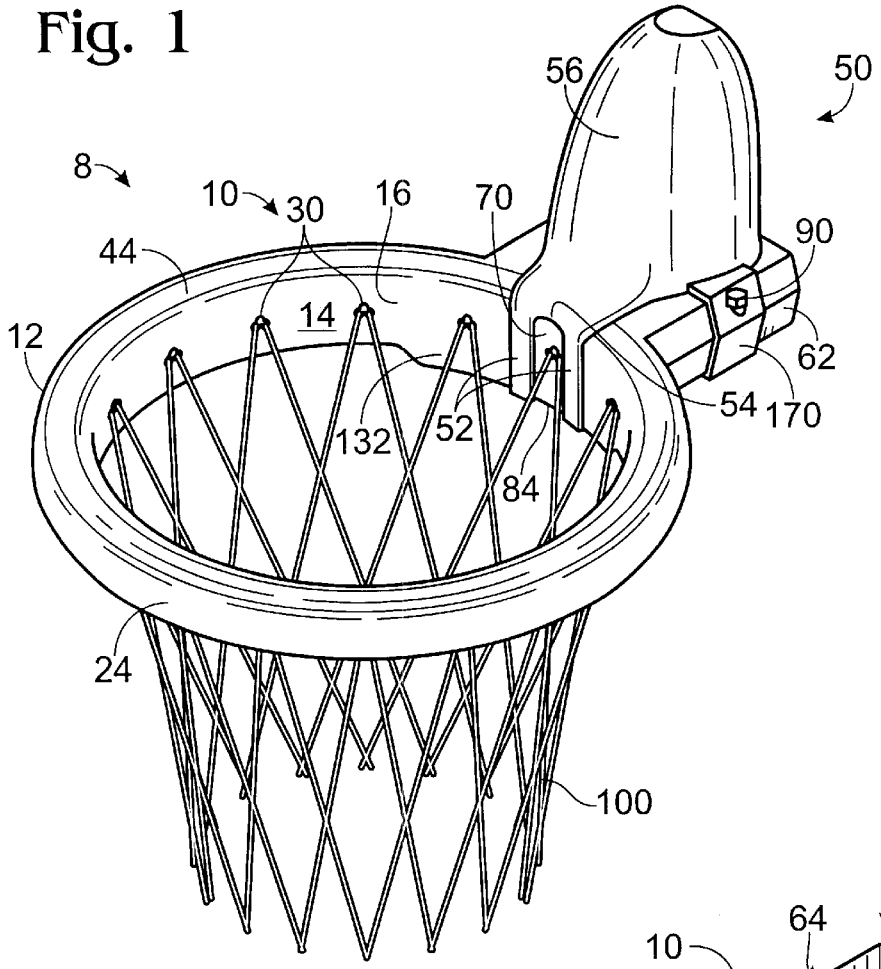
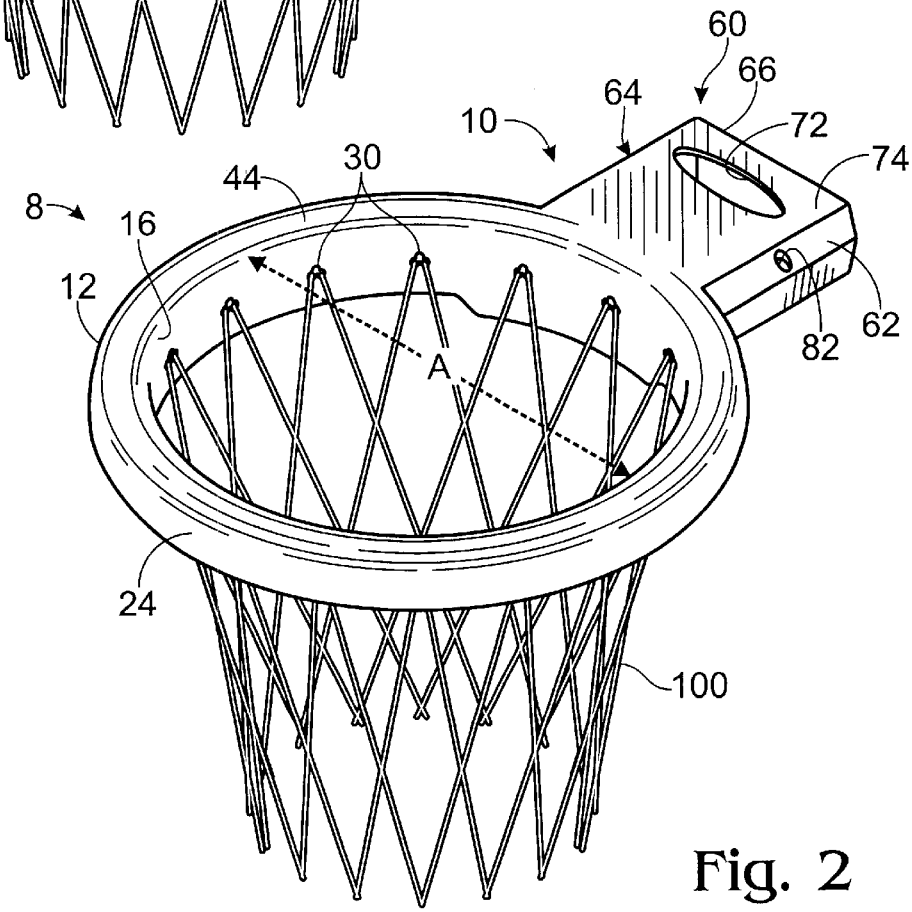
Fig. 2

Fig. 12
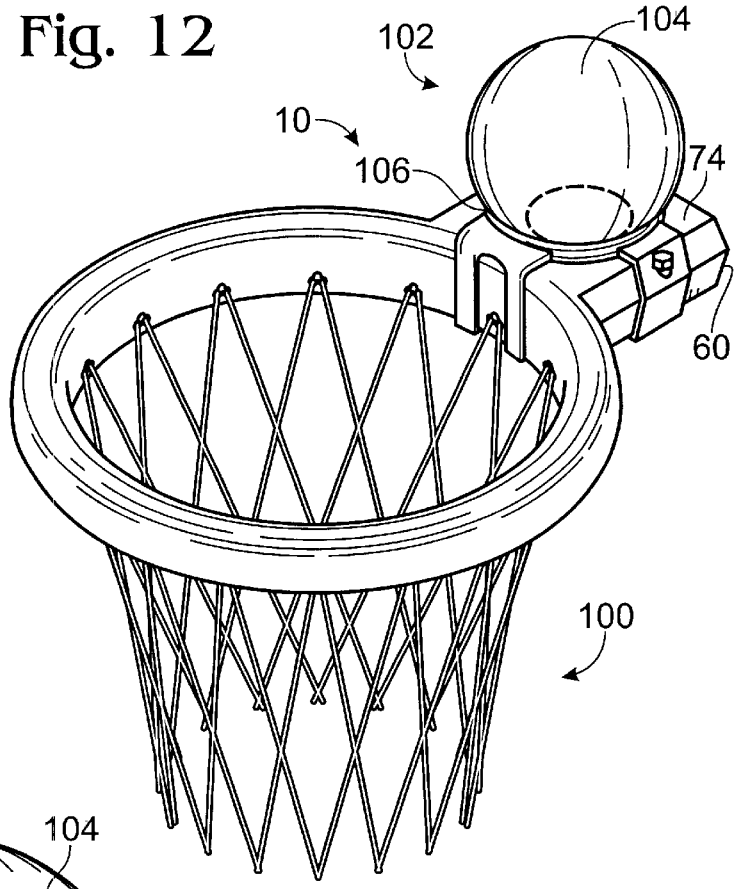
Fig. 13
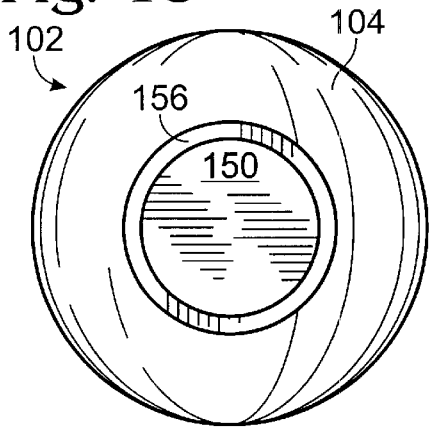
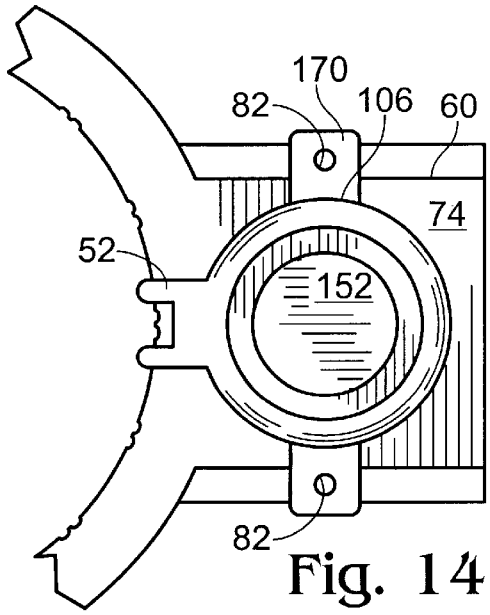
Fig. 14

TRANSPORTABLE BASKETBALL GOAL WITH NET AND TRAINING TOOL

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

This invention relates most generally to games and sports employing netted goals, hoops, or rims through which balls are passed, such as the common game of basketball. This invention relates more specifically to a transportable basketball goal assembly, for use with a pre-existing, permanently installed net-less metal basketball goal.

The standard basketball goal assembly consists of a permanently installed metal annular hoop (primary rim) having an inside diameter of approximately 0.547 meters/18 inches, and having approximately twelve metal ring-shaped hooks welded to the underside of the hoop for attaching a net thereto. An L-shaped metal mount attaches the hoop to a backboard at a predetermined distance therefrom, and fixes the hoop approximately three meters/ten feet above the basketball court surface. The mount itself is less standardized: it is typically found to be either approximately 0.15 meters/five inches or approximately 0.18 meters/six inches in width. The mount fixes the metal hoop a predetermined distance away from the backboard (see Drawings, FIG. 4).

Although basketball players prefer to play with a nylon net in place, many publicly accessible basketball hoops lack nets. Basketball nets have a short life cycle due to play-related wear and tear, and vandalism. Outdoor nets additionally suffer from continued exposure to rain and sun. Replacing a net on the metal hoop is costly and time consuming: the new net must be attached to each of the twelve metal net hooks welded to the permanent hoop, and there is no guarantee how long it will last before it is torn or stolen. Net replacement is also physically challenging: the height of the permanent net hooks requires the availability and use of a ladder or other like means.

Others have sought to provide a transportable net or a secondary rim with a new net already attached to it, for temporary or semi-permanent use with a preexisting goal. Such efforts fall into three broad categories. First, there are nets that wrap around the outside of the metal hoop (e.g., U.S. Pat. No. 4,834,3172 to Qualley, May 30, 1989). Second, there are netted secondary rims designed to hang off and below the rim of the pre-existing metal hoop (e.g., U.S. Pat. No. 1,544,453 to Harbison, Jun. 30, 1925; U.S. Pat. No. 5,098,091 to McGivern, Mar. 24, 1992; U.S. Pat. No. 5,123,642 to Stokes, Jun. 23, 1992; U.S. Pat. No. 5,944,623 to Schlicting, Aug. 31, 1999). Third, there are netted secondary rims designed to rest on top of the rim of the pre-existing metal hoop.

U.S. Pat. No. 4,903,964 (Anderson, Feb. 27, 1990) describes a secondary rim with net that sits on top of the metal hoop by press-fit engagement. Anderson also describes a special installation tool (Anderson FIG. 5) for installing and removing the device without the aid of a ladder. However, if the tool has been broken, lost, or left behind, an ordinary stick cannot suffice, and a ladder or the like must be used to install and remove the device.

U.S. Pat. No. 4,905,995 (Apo, Mar. 6, 1990) describes a secondary rim with net that is adjustable in size and that rests on top of the pre-existing hoop. It too is designed to be installed with a special"placement device" (Apo FIG. 8*c*) having a pair of projecting pins. The rim is removed by throwing the basketball through the hoop from the underside. Because the rim is simply resting upon the pre-existing hoop, it may be easily and unintentionally dislodged during play resulting in lost game time and pinching of a player's fingers or hands when he or she grabs the loose rim. As with Anderson, if the lifting tool has been broken, lost, or left behind, an ordinary stick cannot be employed and a ladder or the like must be used to install the device.

U.S. Pat. No. 5,405,132 (St. Onge, Apr. 11, 1995) describes another secondary rim that sits on top of the metal hoop. It is installed by first clipping the bottom perimeter of the net closed, inserting a basketball into the closed net and tossing the device over and onto a pre-existing hoop. The rim is removed by dislodging it from the metal hoop by hitting the rim with a basketball. Because the rim is simply resting upon the pre-existing hoop, it may easily and unintentionally be dislodged during play, resulting in lost game time and minor yet irritating finger pinching when a player attempts to grab the rim.

U.S. Pat. No. 5,447,304 (Vargas, Sep. 5, 1995) describes a two-tiered removable basketball net assembly comprising a plastic overlay ring which rests on top of the pre-existing metal hoop, and a variety of clips, a sub-set of which releasably grip the metal hoop. The device requires the use of a ladder or the like during installation and removal.

The above-described devices variously have the disadvantages of altering the rim or net performance characteristics of the game; requiring a ladder or special tool for installation or removal, or else are unstable during use. Further, none of the devices are designed to accept an accessory backboard-blocking training tool designed to improve the player's aim.

What is needed and would be useful, therefore, is a device a) that can be temporarily installed over a pre-existing metal goal without a specialized tool; b) that once installed would provide rim and net performance characteristics of a standard basketball goal; c) that would remain firmly installed during game play and thereby reduce "time-outs" needed to re-install the device and finger pinching that may occur when a loose secondary rim is grabbed and unintentionally dislodged; d) that can be stored with the net remaining attached to the secondary rim and thus"ready to go" for the next game; e) that can be carried or stored in a manner that does not damage the rim or net; and f) that can accept one or more accessory training tools that help train the player to make particular kinds of shots, for example, clean shots into the goal hoop (no preliminary rebound off the backboard). It would also be useful for the device to be adaptable to different sizes of L-shaped mounts, so as to maximize the number of pre-existing goals the device could be used with.

SUMMARY OF THE PRESENT INVENTION

The present invention provides a transportable basketball goal apparatus, with net and training tool assembly. The training tool is in the form of a removably attachable backboard block, designed to increase the player's shooting skills. The apparatus can be firmly yet temporarily installed on a pre-existing metal basketball goal with the aid of an ordinary stick or pole, and without the use of a ladder. The base includes an optional insert to allow installation of the rim over a six or five inch pre-existing mount.

DRAWING SUMMARY

FIG. 1 is an isometric view of the basketball goal apparatus, net, and training tool assembly of the present invention, prior to installation on a pre-existing metal basketball goal.

FIG. 2 is an isometric view of the base and net shown in FIG. 1.

FIG. 12 is an isometric view of the training tool ball and cup.

FIG. 13 is a bottom plan view of the ball shown in FIG. 12.

FIG. 14 is a fragmented bottom plan view of the cup shown in FIG. 12.

DETAILED DESCRIPTION OF THE INVENTION

Figure 4:
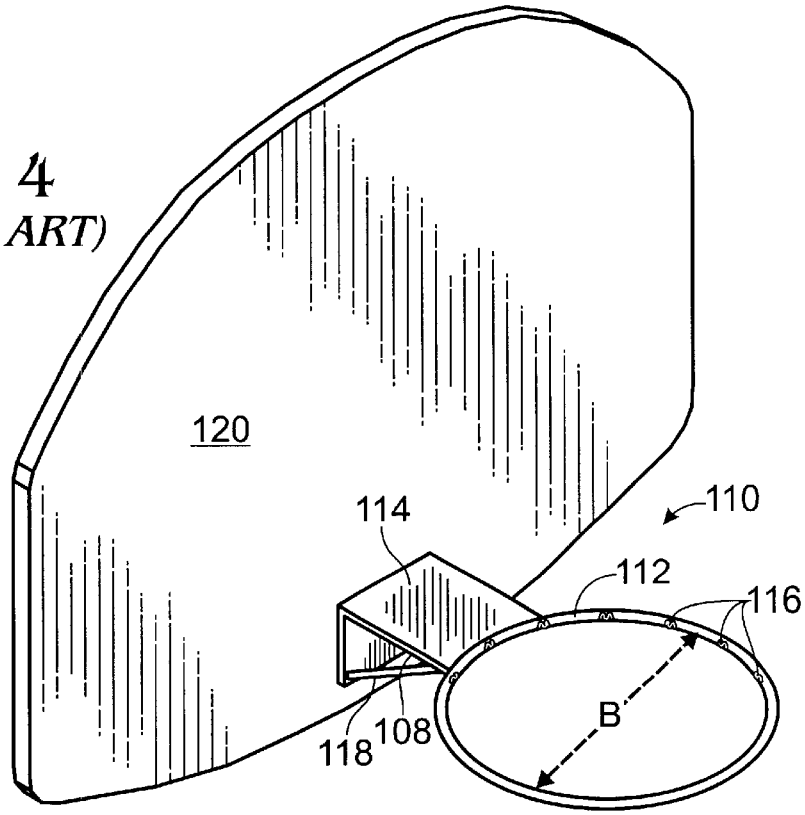
Fig. 4 (PRIOR ART)
FIG. 4 is an isometric view of a pre-existing metal basketball goal.

Referring now to the drawings in greater detail, FIG. 1 shows the preferred embodiment of the transportable basketball goal assembly 8 with net 100 and training tool 50 comprising the present invention. The invention consists of a base 10, a net 100 removably attachable to base 10, and an optional training tool 50 removably attachable to base 10. Base 10 can be manufactured out of any material suitable for providing and withstanding the repeated press-fit installation of base 10 onto a pre-existing standard basketball goal 110, as shown in FIG. 4. Although the invention is described for use with a standard basketball hoop, the invention could be used with other types of pre-existing hoops.

FIG. 2 shows that base 10 has a circular rim 12 and a brace portion 60.

Figure 5:
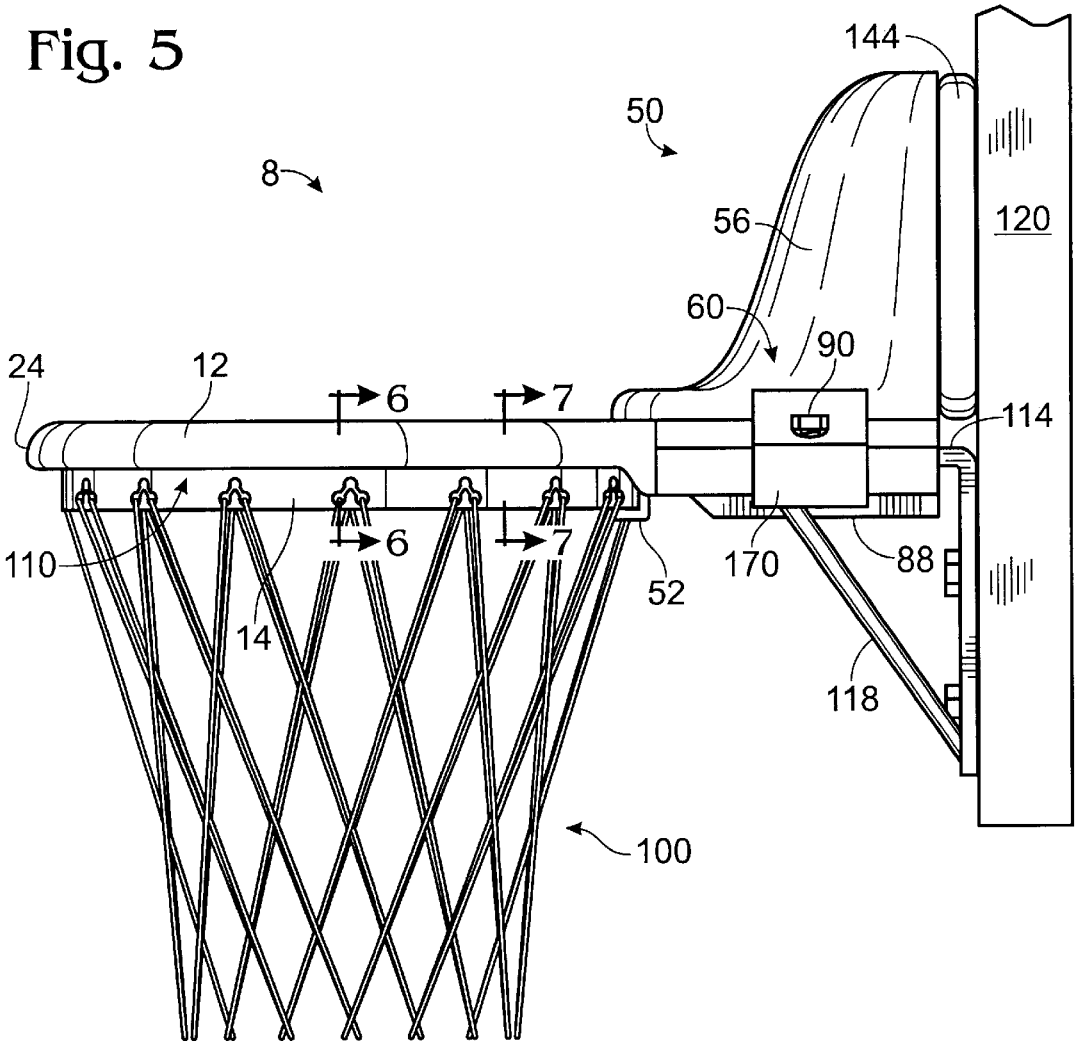
FIG. 5 is a side elevation view of the apparatus and assembly of FIG. 1 installed on the pre-existing metal goal shown in FIG. 4.

With reference to FIG. 4, the prior art provides a standard pre-existing basketball hoop 112 with an inside diameter B of approximately 0.547 meters/18 inches. FIG. 2 shows that rim 12 of the invention has an inside diameter A. Diameter A is of a pre-determined length and is slightly smaller than diameter B, yet large enough so that a standard basketball may freely pass through rim 12 when base 10 is installed on pre-existing goal 110 as shown in FIG. 5.

Figure 7:
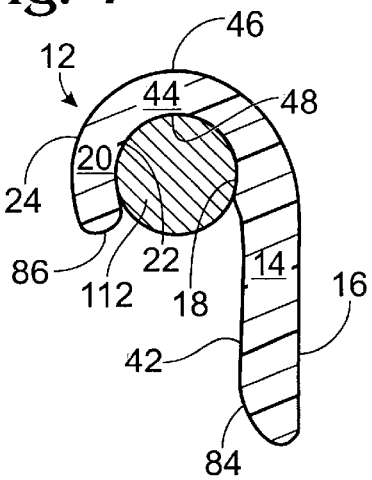
FIG. 7 is a second longitudinal section view of the rim of the device shown in FIG. 5, taken at a location between two net seats.

As shown in FIG. 7, the preferred embodiment of rim 12 has a shoulder 44 that extends to wall 14 and opposing lip 20. Wall 14 extends downwardly from shoulder 44 and has a smoothly continuous inner surface 16 which aperture defines the ball path through rim 12, a rounded bottom edge 84, a slightly curved upper outer surface 18; and a lower outer surface 42. The curve of upper inside surface 18 is designed to match the curve of hoop 112 and thereby provide a snug and stable fit against hoop 112 during game play.

Figure 3:
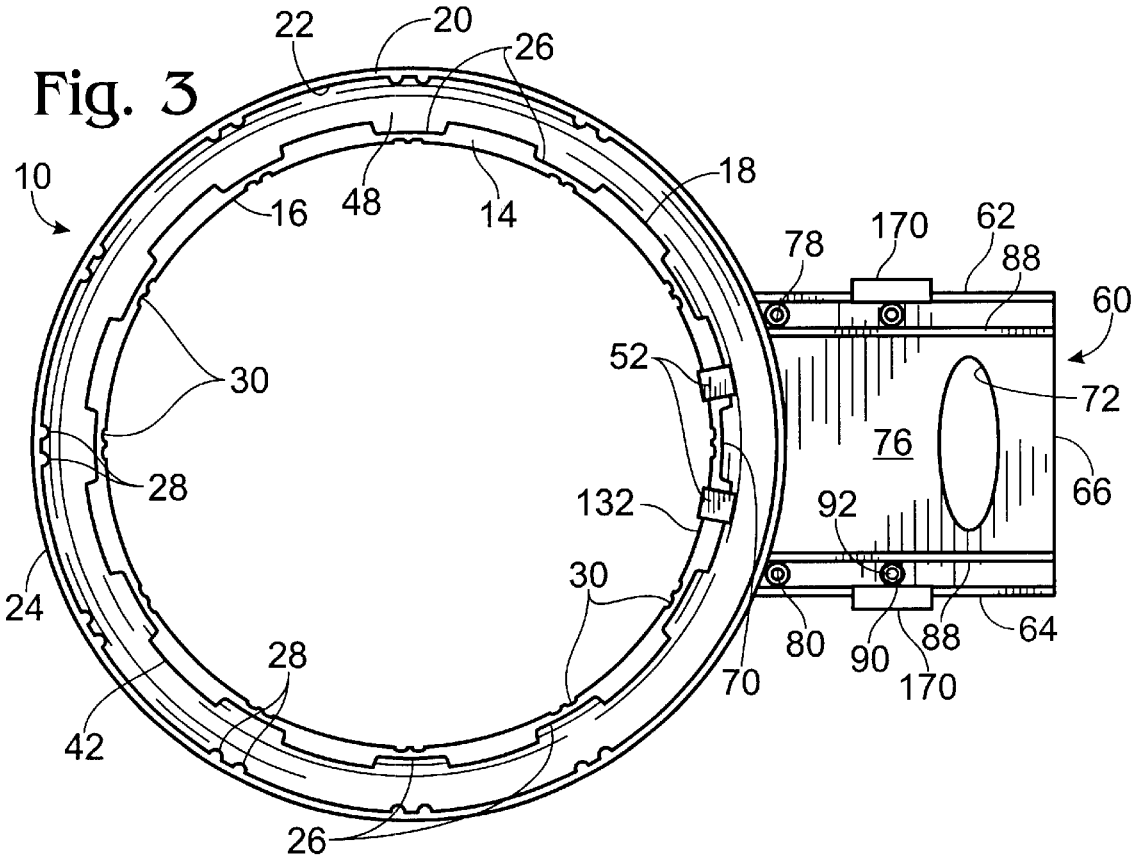
FIG. 3 is a bottom plan view of the base and tool assembly shown in FIG. 2, without the net.
Figure 6:
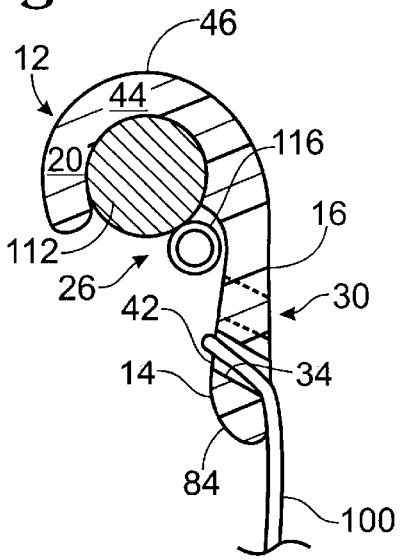
FIG. 6 is a first longitudinal section view of the rim of the device shown in FIG. 5, taken at the location of a metal net hook found on the pre-existing hoop and a corresponding net seat of the invention.

As shown in FIGS. 1 and 3, a plurality of net seats 30 are distributed along wall 14 at pre-determined intervals. Each net seat 30 removably receives an individual portion of net 100. In the preferred embodiment, as shown in FIG. 6, when rim 12 is installed on pre-existing hoop 112, each net seat 30 is proximate to a pre-existing net hook 116 shown in FIG. 4. The alignment of net seats 30 with hooks 116 helps base 10 provide net performance characteristics to the player that are similar to the net performance characteristics that would be provided if net 100 was attached directly to pre-existing net hooks 116. Net performance characteristics include the range and direction of frictional forces that are exerted on a ball as it passes through a netted basketball rim.

Figure 8:
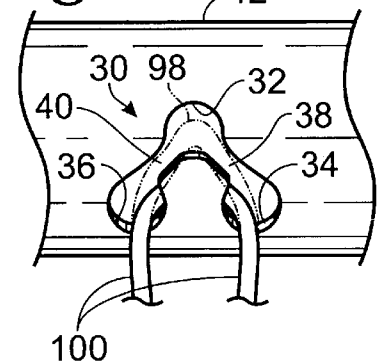
FIG. 8 is an enlarged fragmented side elevation view of a net string and net seat of the device shown in FIG. 2.

As shown in FIG. 8, each net seat 30 is an aperture having three interconnected ports 32, 34, 36 provided in a pyramid or triangle pattern. Ports 32 and 34 are connected by channel 38, ports 32 and 36 are connected by channel 40, and channels 38, 40 are adapted to accept separate portions of net 100. The surface of each net seat 30 is smoothly rounded in order to reduce the wear and tear on net 100, for instance when a basketball passes through the net, or when a player grabs the net and tugs down on it. In the preferred embodiment, as shown in FIG. 8, ports 32, 34, 36 are semicircular in shape and port 32 is located above and between ports 34, 36.

With reference to FIGS. 6 and 8, net 100 is removably attached to rim 12, by the user threading a folded net string 98 through seat 30, starting from inside wall surface 16 and passing through port 32. Folded net string 98 is then allowed to unfold and portions of string 98 pass down channels 38, 40 and come to rest in port 34, 36. A small portion of net 100 is thus secured against wall lower outside surface 42, while the remainder of net 100 hangs down along wall inside surface 16 and below wall bottom edge 84. The design of se at 30 eliminates the need to hand-tie net 100 to rim 12, and reduces the time it takes to attach or remove net 100 t o rim 12. Net 100 can be attached to base 10 before base 10 is installed on pre-existing goal 110 by a user standing or sitting on the ground. Ground-level net attachment and removal eliminates the risk of injury from falling that is posed to a player who must attach or remove a net while standing on a ladder or another player's shoulders, in order to reach the height of pre-existing hoop 112.

As shown in FIGS. 3 and 6, a plurality of cavities 26 are distributed along wall lower outer surface 42 at pre-determined intervals to provide a space in wall 14 for removably receiving each of the twelve metal net hoops 116 found on pre-existing hoop 112, shown in FIG. 4. Each net seat 30 is located within a corresponding cavity 26. When net 100 is installed on base 10, and base 10 is then installed on pre-existing hoop 112, cavities 26 allow rim 12 to be firmly and uniformly press-fit against hoop 112 without interference from pre-existing net hooks 116, thus increasing the stability of the base during game play, and additionally avoiding unnecessary wear on rim wall lower outside surface 42.

The positioning of net seats 30 in the lower portion of wall 14 proximate to cavities 26 allows net 100 sufficient space to abut wall lower outer surface 42 and hang from net loop ports 34, 36 without rubbing against metal net hook 116, thereby prolonging the life of net 100. This disposition also allows rim 12 with attached net 100 to sit firmly and unobstructed on hoop 112, and further allows the replacement net 100 to hang from the approximate position of the original net and thereby provide rim and net performance characteristics to the player that are similar to those provided by a standard netted basketball goal assembly.

In the preferred embodiment, as shown in FIGS. 1 and 6, when rim 12 is installed on hoop 112, wall 14 extends approximately 0.03 meter/1.0 inch below hoop 112. The width of wall 14 is approximately 0.01 meter/0.33 inch except where it is slightly thinner in the vicinity of net seats 30. However, the length and width of wall 14 may vary without departing from the scope of invention, as long as net 100 does not abut pre-existing hoop 112.

As shown in FIG. 7, shoulder 44 extends between wall 14 to lip 20. Lip 20 extends downwardly from shoulder 44 opposite wall 14. Lip 20 has a curved inside surface 22, a rounded outside surface 24, and a rounded bottom edge 86. The curve of lip inside surface 22 is designed to match the curve of hoop 112 and thereby provide a snug and stable fit of lip 20 against hoop 112 during game play. In the preferred embodiment, lip bottom edge 86 is slightly lower than the bottom edge of hoop 112 to ensure a snug snap fit against hoop 112. The width of lip 20 may vary without departing from the scope of invention, so long as rim 12 can withstand repeated press-fit installations and provide a snug fit such that a player's finger or hand does not become pinched if the player grabs the rim. The width of lip 20 is approximately 0.01 meters/0.33 inch, but lip width may vary without departing from the scope of the invention.

As shown in FIG. 7, shoulder under surface 48 has a curved shape designed to match the curve of pre-existing hoop 112 and thereby provide a snug and stable fit against hoop 112 during game play.

As shown in FIG. 7, all exposed edges and surfaces of rim 12, including rim shoulder top surface 46, wall bottom edge 84, and lip bottom edge 86, are smoothly rounded to allow the player to grasp rim 12 without injuring his or her hand.

As shown in FIG. 3, there are a plurality of pairs of button-like protrusions 28 along lip inside surface 22, and each pair of protrusion 28 is located approximately opposite to a net seat 30.

In the preferred embodiment, there are nine pairs of protrusions 28, and a pair is provided approximately opposite each net seat 30, except for the three net seats closest to brace 60, that is net seat 30 at rim position 70 and the net apertures either side thereto. Pairs of protrusions 28 help secure base 10 to the hoop 112 at locations along rim 12 that are most likely to be dislodged during play, namely, where net 100 is attached thereto.

Although the preferred embodiment has nine pairs of securing protrusions 28, an alternative embodiment could lack said protrusions and rely only on the curved inside surface of rim 12, the length of wall 14, the length of lip 20, and the press-fit design of base 10 for stability of base 10 during game play.

With reference to FIG. 2, brace 60 includes a ledge 66, and a pair of elongated, sloped sides 62, 64 extending downwardly therefrom. FIG. 3 shows that brace 60 has an under surface 76 of a pre-determined shape shaped to fit over the pre-existing mount 114, shown in FIG. 4. Brace sides 62, 64 are designed to avoid goal side arms 118, as shown in FIGS. 4 and 5. Sides 62, 64 are sloped so that if a basketball hits side 62, the ball will roll down or be otherwise deflected away from rim 12.

Figure 9:
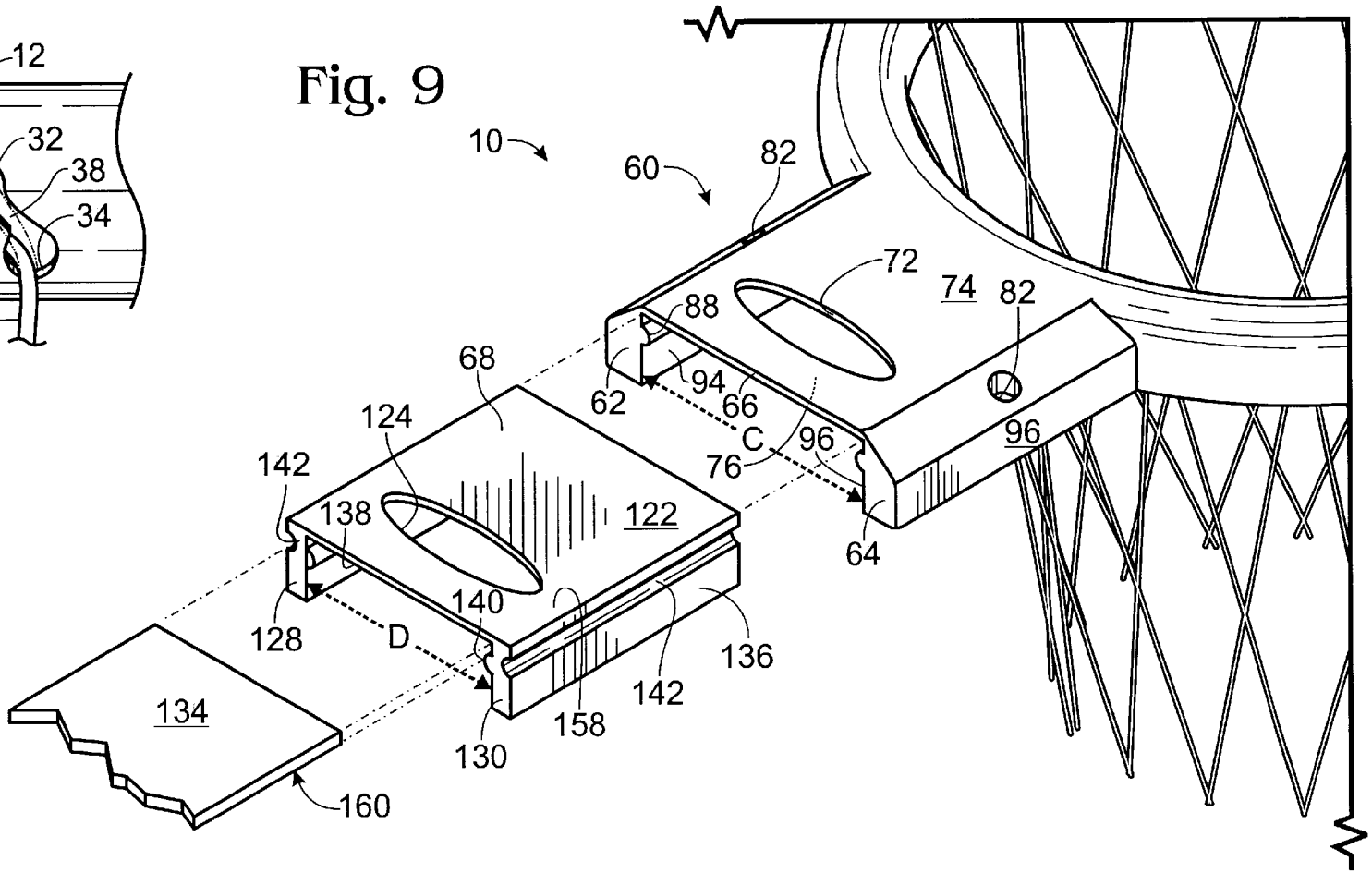
FIG. 9 is a fragmented, exploded isometric view of the device shown in FIG. 2, showing the optional ledge insert (122) that allows the device (10) to fit upon a pre-existing hoop's five inch-wide mount (134).

As shown in FIG. 9, the distance C between sides 62, 64 is predetermined. In the preferred embodiment, distance C is approximately 0.18 meters/six inches, in order to facilitate a snug fit of brace 60 onto pre-existing six-inch wide mount 114.

As shown in FIGS. 3 and 9, the preferred embodiment of base 10 also has a pair of mutually opposing elongated ridges 88 located on brace side inner surfaces 94, 96. Ridges 88 secure and stabilize brace 60 to either the permanent mount 114 shown in FIG. 4, or to the ledge insert 122 shown in FIG. 9. As shown in FIG. 9, ridges 88 are located approximately 0.1 meter/0.38 inch below ledge 66, and are designed to press-fit directly to the underside 108 of mount 114, shown in FIG. 4.

Alternatively, as shown in FIG. 9, if base 10 is to be installed on a pre-existing mount 134 that is approximately 0.15 meter/5 inches wide, brace insert 122 may be first removably received by brace 60 to adapt brace 60 to mount 134. As shown in FIG. 9, insert 122 has a ledge 68, and a pair of legs 128,130 extending downwardly from the ledge. The outer surface 136 of each leg 128, 130 has a cavity 142 is of a predetermined cross-sectional area sized to slidably and removably receive the corresponding ridge 88 of a brace leg, thereby to bring insert upper surface 158 into contact with brace under surface 76. When base 10 is fitted with optional insert 122 and then press-fit onto five-inch wide mount 134, insert under surface 138 will rest on mount 134 shown in FIG. 9, and insert ridges 140 will abut the under surface 160 of mount 134 and help secure base 10 to goal mount 160. As shown in FIG. 9, distance D between insert opposing sides 128, 130 is approximately 0.15 meters/5 inches, in order to facilitate a snug fit of insert 122 onto five-inch wide mount 134.

In the preferred embodiment shown in FIG. 9, brace portion 60 is designed to fit onto six-inch wide mount 114, but brace 60 could be manufactured to fit directly onto a five-inch wide mount. Insert 122 could be designed to adapt base 10 to other mounts having a different predetermined shape, without departing from the scope of the invention. In the preferred embodiment shown in FIG. 9, insert 122 has a large aperture 124 designed to align with and match brace aperture 72.

Brace 60 stabilizes rim 12 on pre-existing hoop 112 and provides a means for installing and removing base 10. As shown in FIG. 3, brace underside 76 provides tubs 78, 80 of a pre-determined size for removably receiving the end of a common stick, broom, threaded paint roller dowel, or the like, during installation of base 10 onto goal 110, and similarly during removal therefrom. In the preferred embodiment, two tubs 78, 80 are present, however only one tub may be presented. A particular tub may be threaded 78 toor not threaded 80.

As shown in FIG. 2, ledge 66 provides a large aperture 72 for use as a carrying handle or storage hanger, so that neither rim 12 nor net 100 needs to be grasped during transport or storage. The entire device 8, or just the base 10 with net 100 attached, can be safely and conveniently stored off the ground by hanging it by aperture 72, on a wall hook or nail.

As also shown in FIG. 2, brace 60 has an upper surface 74 designed to removably receive training tool 50. As shown in FIG. 9, brace 60 has two apertures 82 that are spaced a predetermined distance apart from each other, for removably receiving a bolt therethrough.

As shown in FIG. 1, training tool 50 has a backboard-blocking means 56 designed to deflect certain types of incoming shots from pre-existing backboard 120, and thereby assist the player in learning shooting and rebounding skills. In particular, training tool 50 is designed to prevent an incoming basketball from hitting backboard 120 and subsequently passing through rim 12. Use of training tool 50 thus requires the player to make a"clean shot" into rim 12 instead of a bank shot.

Figure 10:
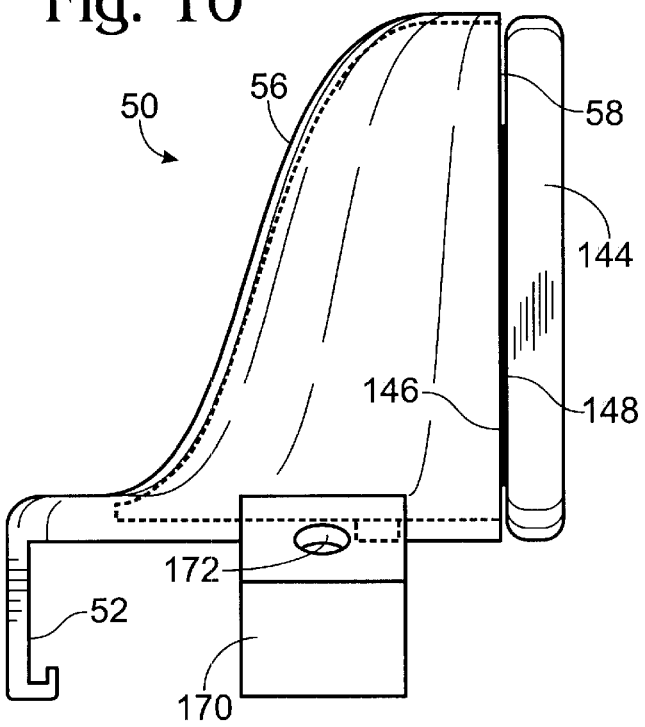
FIG. 10 is an side elevation view of the training tool dome shown in FIG. 5 with optional backing pad.

As shown in FIGS. 1 and 10, training tool 50 has means for removable attachment to brace 60. In the first and second embodiments of tool 50, shown in FIGS. 1, 12, 14, the attachment means consists of J-flange 52 descending downwardly from training tool means 56 and base wings 170, however other means could be employed without departing from the scope of the invention. As shown in FIGS. 1, 5, flange 52 is removably received by wall surface 16 and wall bottom edge 84. Flange 52 splits at training tool base 54 shown in FIG. 1 to descend therefrom without obstructing net seat 30 found at rim position 70 shown in FIG. 3. The section of wall 14 near position 70 provides a catch 132 for J-flange 52. As shown in FIG. 1, this wall section is slightly longer than the other wall portion, in order to provide increased stability to tool 50 during play, but the wall length could be uniform throughout. As shown in FIGS. 1, 2, 3, 11, base wings 170 extend outwardly from said blocking means 56 and provide bolt receiving apertures 172 that are positioned and sized to align with bolt receiving apertures 82 of brace 60. As shown in FIGS. 1, 3, when tool 50 is attached to base 10, each bolt 90 is secured by nut 92 against the under surface 76 of brace 60 proximate to sides 62, 64.

Figure 11:
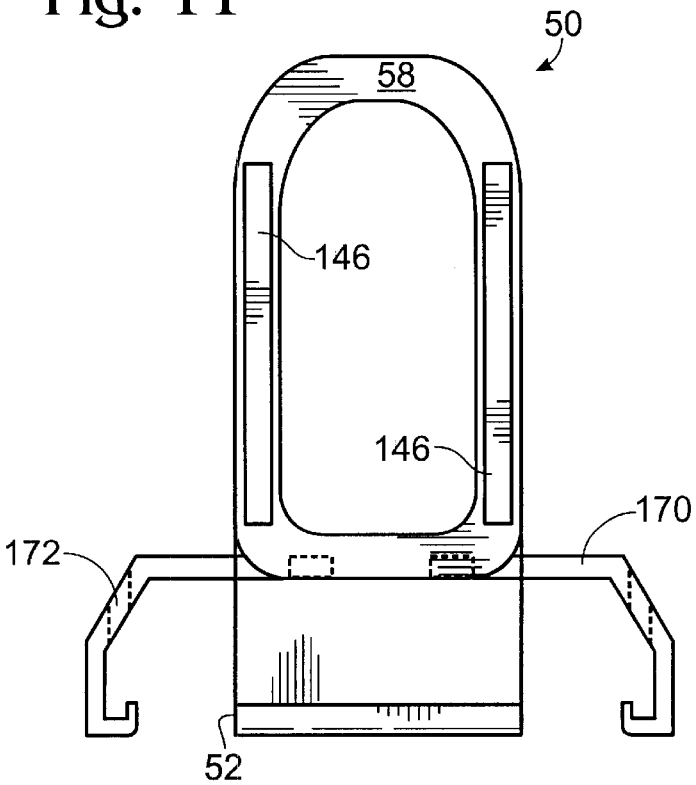
FIG. 11 is a rear elevation view of the training tool dome shown in FIG. 10.

As shown in FIG. 10, in the first embodiment of training tool 50 the backboard-blocking portion of tool 50 is shaped as a bull-nosed dome 56. As shown in FIGS. 10 and 11, this dome has flat back portion 58, which can removably receive an optional pad 144. Pad 144 cushions and supports tool 50 against backboard 120 shown in FIG. 4, and also serves to adapt tool 50 to variations in the distance that different pre-existing hoops 112 may be from their backboards 120. In the embodiment shown, pad 144 removably attaches to tool back 58 by VELCRO® patches 146, 148 as shown in FIGS. 10 and 11, but pad 144 could be permanently attached to tool 50 by glue means.

As shown in FIG. 12, a second embodiment of training tool 50 is provided by ball 104 which is removably received by cup 106. In the embodiment shown, ball 104 removably attaches to cup 106 by VELCRO® patches 150, 152 as shown in FIGS. 13 and 14, but ball 104 and cup 106 could be permanently attached to each other by glue means. Cup 106 is removably receivable upon brace upper surface 4, and has two wings 170 extending outwardly with bolt apertures 82 for removable attachment to brace 60, and downwardly extending J-flange 52 for removable attachment to rim 12 in the manner previously described.

Base 10 can be installed on pre-existing hoop 110 without attaching optional training tool 50, and without the use of a ladder, by inserting a common broom or stick end into one of the tubs 78, 80, raising the device and positioning it over the pre-existing hoop 112, and then removing the broom or stick. Using the same broom or stick, the user then simply presses down along the top of the device causing the device to snap or press-fit onto the pre-existing hoop 112. The device can be easily removed without the aid of a ladder by inserting the end of a broom or stick into one of the tubs 78, 80 and gently prying the device off.

It will be understood by those of ordinary skill in the art that other arrangements and disposition of the aforesaid components, the descriptions of which are intended to be illustrative only and not limiting, may be made without departing from the spirit and scope of the invention, which must be identified and determined from the following claims and equivalents thereof.

I claim:

1. A transportable basketball goal apparatus, for use with a pre-existing metal frame, comprising:

a base;

a net having foldable strings removably attachable to said base;

said base comprising a circular rim, and a brace extending radially from said rim;

said rim comprising a shoulder, a wall extending downwardly from said shoulder, and a lip extending downwardly from said shoulder opposite said wall;

said rim shoulder comprising a smoothly rounded top surface, and a curved under surface providing means for snug and stable fit against a pre-existing basketball hoop, said shoulder extending to and between said wall and said lip;

said rim wall having a smoothly continuous inner surface defining an aperture of a predetermined diameter for passage of a ball therethrough, a rounded bottom edge, a curved upper outer surface providing means for a close and stable fit against a pre-existing basketball hoop, and a lower outer surface having multiple cavities at pre-determined intervals therealong for removably receiving net hoops of a pre-existing basketball hoop;

each said wall cavity further comprising a net seat having a smoothly rounded surface;

each said net seat further comprising an aperture for removably receiving said foldable net strings therethrough and to said rim, each said net seat aperture having a first, second and third port said first port positioned above and between said second and third ports, and a first channel connecting said first port to said second port; and a second channel connecting said first port to said third port; said net seat;

said rim lip extending downwardly from said shoulder opposite said rim wall and having a curved inside surface providing means for a close and stable fit against a pre-existing basketball hoop, a rounded outside surface, and a rounded bottom edge;

said base brace comprising a ledge, first and second opposing sides extending downwardly from said ledge at a pre-determined distance thereapart, a brace upper surface, and a brace under surface;

said ledge comprising an aperture therethrough for removably receiving a hand or storage hangar;

said brace under surface comprising a tub for removably receiving the end of a pole or dowel;

said first and second opposing sides each having an inner surface, each said inner surface comprising an elongated horizontal ridge.

2. The device of claim 1 wherein said brace further comprises an insert, said insert comprising a ledge having an aperture of a pre-determined size for receiving a hand or storage hook;

first and second legs extending downwardly from said insert ledge;

an upper surface;

an under surface;

each said leg having an outer surface comprising an elongated horizontal cavity of pre-determined cross-sectional area sized for removably receiving said brace leg inner surface elongated ridge, and having an inner surface, each said inner surface comprising an elongated horizontal ridge; and wherein said insert is removably receivable between each said first and second brace legs.

3. The device of claim 1 further comprising a removably receivable training tool comprising means to block a pre-existing backboard, and means for removably attaching said deflecting means to said base;

said attaching means comprising a J-flange extending downwardly from said backboard blocking means and removably received by said base wall;

a first and second base wing extending outwardly from said backboard blocking means, each said wing providing an aperture for removably receiving a bolt therethrough, and each wing removably receivable on said base brace upper surface;

wherein each of said base brace sides further comprises an aperture at a pre-determined distance for removably receiving a bolt therethrough.

4. The device of claim 3 wherein said brace further comprises an insert, said insert comprising a ledge having an aperture of a pre-determined size for receiving a hand or storage hook;

first and second legs extending downwardly from said insert ledge;

an upper surface removably receivable by said brace under side;

each said leg having an outer surface comprising an elongated horizontal cavity of pre-determined cross-sectional area sized for removably receiving said brace leg inner surface elongated ridge, and having an inner surface, each said inner surface comprising an elongated horizontal ridge; and wherein said insert is removably receivable between each said first and second brace legs.

5. The device of claim 3 wherein said backboard deflecting means comprises a dome integrally formed with said J-flange and said wings.

6. The device of claim 5 wherein said brace further comprises an insert, said insert comprising a ledge having an aperture of a pre-determined size for receiving a hand or storage hook;

first and second legs extending downwardly from said insert ledge;

an upper surface removably receivable by said brace under side;

each said leg having an outer surface comprising an elongated horizontal cavity of pre-determined cross-sectional area sized for removably receiving said brace leg inner surface elongated ridge, and having an inner surface, each said inner surface comprising an elongated horizontal ridge; and wherein said insert is removably receivable between each said first and second brace legs.

7. The device of claim 5 further comprising a pad receivable by said dome.

8. The device of claim 6 further comprising a spacer pad receivable by said dome.

9. The device of claim 3 wherein said backboard deflecting means comprises a cup integrally formed with said J-flange and said wings, and a ball receivable in said cup.

10. The device of claim 4 wherein said backboard deflecting means comprises a cup integrally formed with said J-flange and said wings, and a ball receivable in said cup.

11. The device of claim 1 wherein said base rim lip inside surface further comprises multiple pairs of protrusions, wherein each pair of protrusions is provided approximately opposite each said base rim wall cavity.

12. The device of claim 11 wherein the number of pairs of protrusions is nine.

13. The device of claim 2 wherein said base rim lip inside surface further comprises multiple pairs protrusions, wherein each pair of protrusions is provided approximately opposite each said base rim wall cavity.

14. The device of claim 13 wherein the number of pairs of protrusions is nine.

15. The device of claim 3 wherein said base rim lip inside surface further comprises multiple pairs of protrusions, wherein each pair of protrusions is provided approximately opposite each said base rim wall cavity.

16. The device of claim 15 wherein the number of pairs of protrusions is nine.

17. The device of claim 4 wherein said base rim lip inside surface further comprises multiple pairs of protrusions, wherein each pair of protrusions is provided approximately opposite each said base rim wall cavity.

18. The device of claim 17 wherein the number of pairs of protrusions is nine.

* * * * *